US006293351B1

(12) United States Patent
Schmidt

(10) Patent No.: US 6,293,351 B1
(45) Date of Patent: Sep. 25, 2001

(54) REAR MOUNTED THREE POINT HITCH ADAPTER FOR MOTOR VEHICLES

(75) Inventor: Robert A. Schmidt, 389 W. Hunter Creek Rd., Lapeer, MI (US) 48446

(73) Assignee: Robert A. Schmidt, Lapeer, MI (US)

( * ) Notice: Subject to any disclaimer, the term of this patent is extended or adjusted under 35 U.S.C. 154(b) by 0 days.

(21) Appl. No.: 09/769,807

(22) Filed: Jan. 26, 2001

(51) Int. Cl.[7] ..... E01H 5/06

(52) U.S. Cl. ..... 172/439; 172/443; 172/445.1; 172/679; 172/684.5; 37/268

(58) Field of Search ..... 172/439, 443, 172/445.1, 677, 679, 684.5; 37/268, 232

(56) References Cited

U.S. PATENT DOCUMENTS 3,576,267 * 4/1971 Blevins et al. .
4,215,496 * 8/1980 Wehr ..... 37/117.5
4,369,590 * 1/1983 Miller ..... 37/231
4,403,432 * 9/1983 Biance ..... 37/253
5,595,007 * 1/1997 Biance ..... 37/268

* cited by examiner

*Primary Examiner*—Christopher J. Novosad

(57) ABSTRACT

A motor vehicle trailer hitch adapter that mates with a motor vehicle trailer hitch receptacle and provides attachment of standard agricultural category one three point hitch implements such as scraper blades, landscaping rakes or box blades. The adapter comprises of a tube that interfaces with the motor vehicle hitch receptacle, a bracket that interfaces with the category one implement's two pivot post attachment points, and a winch that interfaces with the category one implement's upper attachment point for raising and lowering the implement. The electric winch contains a wire harness that is routed into the vehicle for power attachment and vehicle operator control of the winch. The motor vehicle battery powers the winch through an interface such as a cigarette lighter socket.

1 Claim, 3 Drawing Sheets

REAR MOUNTED THREE POINT HITCH ADAPTER FOR MOTOR VEHICLES

BACKGROUND OF THE INVENTION

1. Field of the Invention

This invention relates in general to vehicle mounted scrapers and in particular to a novel hitch mounted adapter allowing attachment of agricultural category one three point hitch implements.

2. Description of Prior Art

There are many types of motor vehicle attachment methods for scrapers. These attachments allow light trucks and the like to clear snow or perform grading work. Generally snow plows are mounted on the front of the vehicle and have hydraulic means for controlling the blade height and angle. These snow plows are expensive because they have unique mounting hardware for particular vehicle platforms. They also require attachment to the front frame of the vehicle which makes assembly and disassembly time consuming and difficult. Another disadvantage of this mounting configuration is that snow coming off the top of the blade can obstruct the driver's vision. This arrangement of the blade can also obstruct the vehicle headlights requiring the addition of lights on the top of the blade which increases the total cost.

Another means of adding a scraper blade to a vehicle is by attaching it to the rear of the vehicle. This eliminates some of the above noted problems of the front mounted blade. The vehicle headlights are not obstructed and snow coming off of the blade will not obstruct the driver's vision.

In order to provide background information so that the invention may be completely understood and appreciated in its proper context, reference is made to a number of prior art patents. U.S. Pat. No. 4,215,496 of Wehr shows a typical front mounted snow plow blade. These systems require complex brackets to attach to the front of the vehicle and also require an additional set of headlights because the blade obstructs the vehicle headlights. The brackets need to be designed for specific vehicle frame configurations requiring additional design work and product proliferation resulting in increased cost per unit.

U.S. Pat. Nos. 4,403,432 and 5,595,007 of Biance show a rear mounted scraper blade that adapts to the motor vehicle's trailer hitch receptacle. The disadvantage of this design is that it is designed around a particular scraper blade design. It does not use existing scraper blade standards that are produced in higher volume and therefore the total design offers less flexibility and more cost.

U.S. Pat. No. 4,369,590 of Miller shows a rear mounted blade assembly that is mounted directly to the rear frame of the vehicle. This has similar disadvantages to the front mount snow plow in that unique brackets would be required for different vehicle frame designs. It also has the same disadvantages of Biance in that the scraper blade is a unique design and therefore offers less flexibility and more cost.

The present invention is intended to overcome the above described shortcomings of conventional front mounted snow plows and rear mounted scrapers.

SUMMARY OF THE INVENTION

A motor vehicle trailer hitch adapter is provided which mates with a standard square motor vehicle trailer hitch receptacle and provides attachment of standard agricultural category one three point hitch implements such as scraper blades, landscaping rakes or box blades. The adapter comprises of a tube that interfaces with the motor vehicle hitch receptacle, a bracket that interfaces with the category one implement's two pivot post attachment points, and a winch that interfaces with the category one implement's upper attachment point for raising and lowering the implement. The electric winch contains a wire harness that is routed into the vehicle for power attachment and vehicle operator control of the winch. The motor vehicle battery powers the winch through an interface such as a cigarette lighter socket.

The present invention further includes a slot in the hitch adapter pivot point bracket to allow easy attachment of the implement's post attachment points. A plate is then bolted onto the bracket to keep the implement from coming out of the slot during operation. The hitch adapter is designed to withstand the forces exerted by the implement during operation.

It is the object of the present invention to provide an adapter for a motor vehicle which connects to the trailer hitch receptacle and provides an attachment point for standard agricultural three point hitch implements such as scraper blades, landscape rakes and box blades.

Another object of the invention is the provision of such an adapter to be conveniently secured to and removed from the vehicle in a very rapid manner.

Among still other objects of the invention may be noted the provision of such an adapter which utilizes a remotely controlled mechanism for raising and lowering of the blade; which is relatively easily manufactured and assembled; which is extremely rugged, durable and long lasting in operation.

These and other objects, features and advantages will become readily apparent from the following description and accompanying sheets of drawings.

DESCRIPTION OF THE PREFERRED EMBODIMENTS

Figure 1:
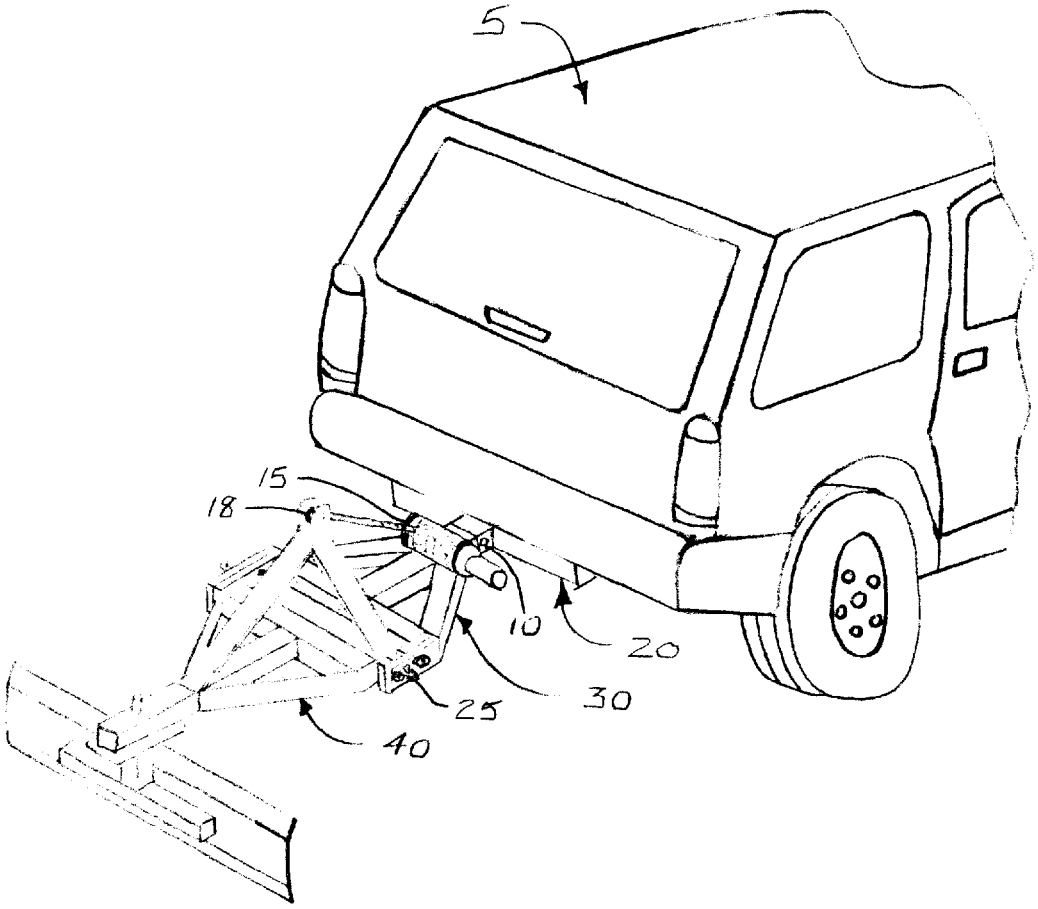
FIG. 1 is a perspective view of a vehicle equipped with a rear mounted category one agricultural scraper blade adapted to a hitch adapter made in accordance with the present invention.

The main sections and parts of the invention are described on the basis of the indicative example below wherein the item numbering corresponds to the drawing.

Figure 2:
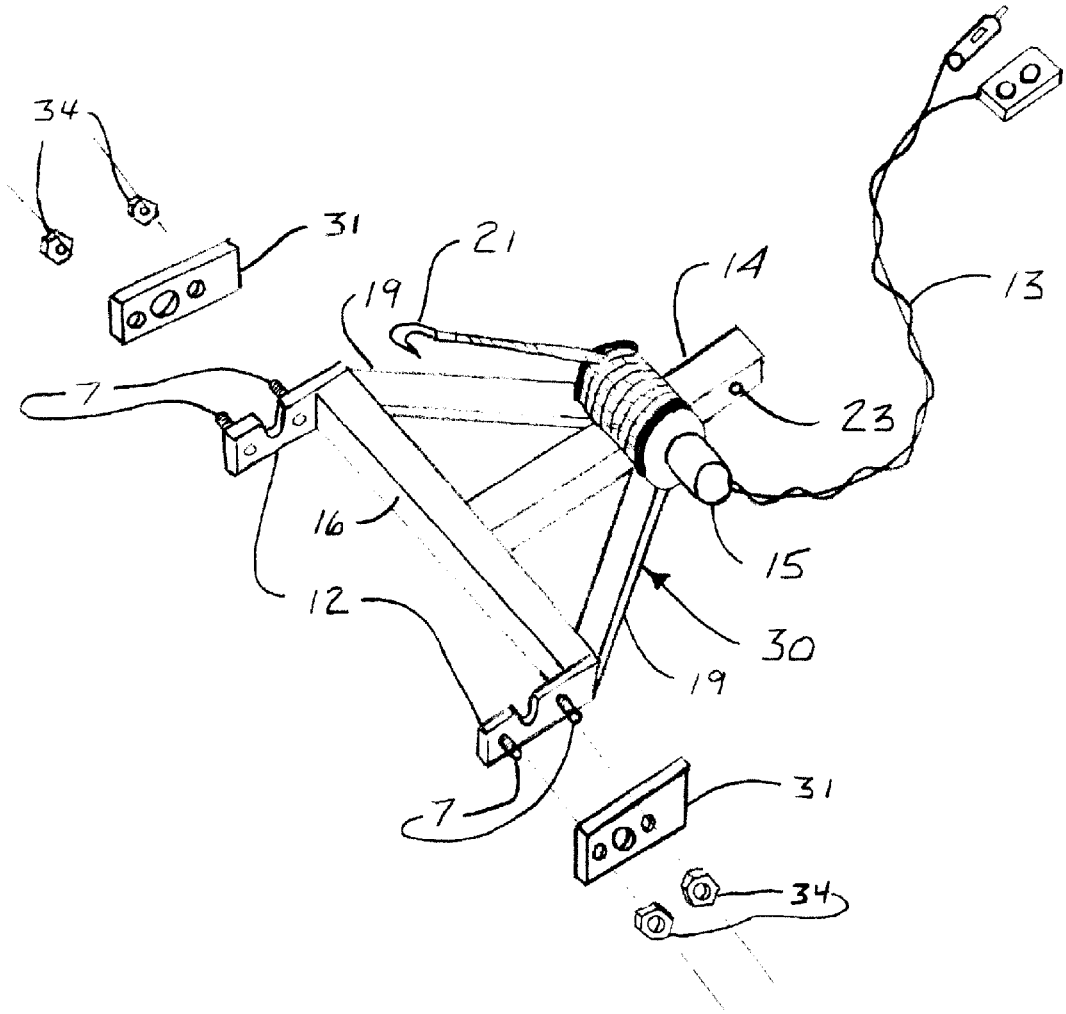
FIG. 2 is a perspective view of the hitch adapter.

A rear mounted three point hitch adapter 30, made in accordance with the present invention, is shown in FIG. 2. The adapter 30 is attached to the motor vehicle 5 at its hitch 10 and is held in place with a pin as would a typical ball hitch receptacle. The adapter 30, allows the attachment of an agricultural category one implement such as a blade scraper 40 as shown in FIG. 1.

The adapter 30, consists of a square tube 14 that is welded or otherwise connected to an angle iron brace 16. The tube 14 slides into the vehicle hitch receptacle 10 and is held in place with a pin through the hole 23. Hole 23 is sized identical to a typical ball hitch receptacle pin interface. The brace 16 is supported by two angle iron brackets 19 that are welded or otherwise attached to the brace 16 and the tube 14. Brace 16 is sized to interface with the standard category 1 implement width.

Figure 3:
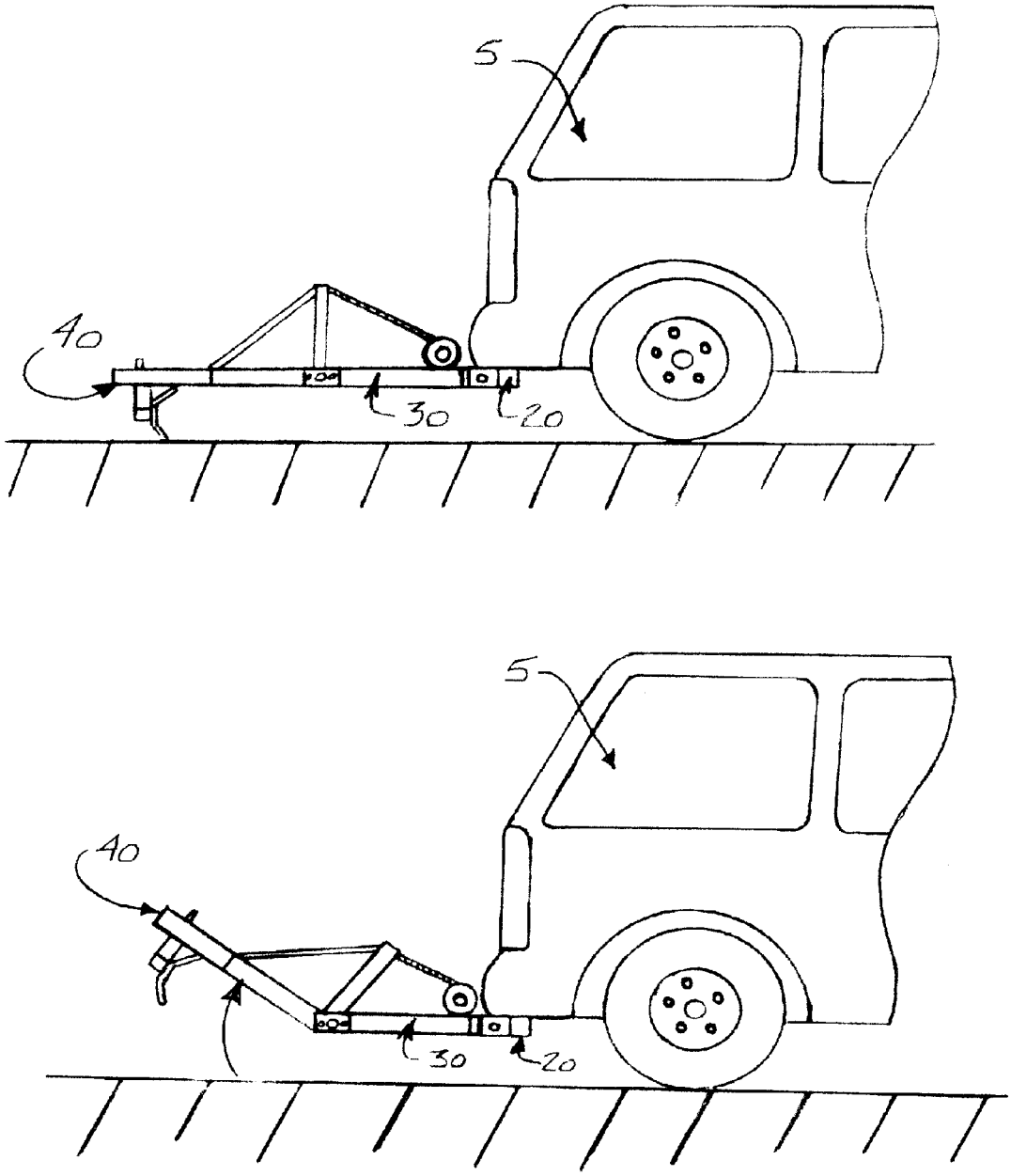
FIG. 3 is a side elevation view of a vehicle equipped with a rear mounted category one agricultural scraper blade showing the up and down positions of the blade.

The electric winch 15 is bolted to the tube 14 and its hook 21 is attached to the category one implement at 18. When the electric winch 15 is operated, it pulls the category one hitch point 18 towards the winch causing the implement to pivot at the pivot post 25 resulting in the implement being raised as shown in FIG. 3. Tube 14 is sized so that when the implement is raised, point 18 will not come in contact with the vehicle. It also cannot be too long or it will allow the implement 40 to put too much cantilever load on the vehicle 5 when the implement is in the up position. The winch contains a wire harness 13 that is routed through the back of the vehicle 5 into the passenger compartment for power hook-up and operator control of up and down motion of the implement 40.

A pivot interface bracket 12 is welded to the brace 16 and has a slot that interfaces with the category 1 implement pivot post 25. Two studs 7 are welded to the bracket 12 to provide attachment for plate 31 which slides over the post 25 and studs 7, and is secured with two nuts 34. The plate 31 insures that the post 25 does not come out of the slot in the bracket 12 during operation.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A three point hitch adapter for motor vehicles comprising:

a tube that is sized to mate with a motor vehicle hitch receptacle;

a brace that is attached to the tube that provides a means for attachment of three point hitch implement pivot posts;

a bracket attached to each end of the tube and brace for structural support;

an electric winch that is mounted to the tube and whose cable is attached to the three point hitch implement pivot posts to provide a means of raising and lowering the three point hitch implement pivot posts;

a wire harness that is attached to the electric winch that is of sufficient length to route into a vehicle compartment for power hook-up and vehicle operator control of the winch.

* * * * *